US005243799A

United States Patent [19]

Schlüter

[11] Patent Number: 5,243,799

[45] Date of Patent: Sep. 14, 1993

[54] DEVICE FOR FORMING A CONNECTING TRANSITION BETWEEN TWO SURFACES WITH RIGID COVERINGS ABUTTING ONE ANOTHER AT RIGHT ANGLES

[75] Inventor: Werner Schlüter, Iserlohn, Fed. Rep. of Germany

[73] Assignee: Schlüter Systems GmbH, Iserlohn, Fed. Rep. of Germany

[21] Appl. No.: 985,892

[22] Filed: Dec. 4, 1992

[30] Foreign Application Priority Data

Dec. 17, 1991 [DE] Fed. Rep. of Germany ..... 4141601

[51] Int. Cl.[5] ..... E04B 1/00; E04B 1/68; E04B 1/98; E04B 5/00

[52] U.S. Cl. ..... 52/282.1; 52/393

[58] Field of Search ..... 52/267, 269, 276, 278, 52/285, 249, 393, 573

[56] References Cited

U.S. PATENT DOCUMENTS

| | | | |
|---|---|---|---|
| 3,667,177 | 6/1972 | Biela | 52/278 |
| 3,680,898 | 8/1972 | Herrmann | 52/285 X |
| 3,811,241 | 5/1974 | Mattix | 52/285 |
| 5,125,204 | 6/1992 | Porter | 52/393 |

FOREIGN PATENT DOCUMENTS 3503396 8/1986 Fed. Rep. of Germany .

*Primary Examiner*—Neill R. Wilson
*Attorney, Agent, or Firm*—Collard & Roe

[57] ABSTRACT

A device for forming a connecting transition bridge expansion joint between two surfaces having hard coverings abutting one another at right angles is located between a wall and the floor, where the surfaces are preferably covered with ceramic tiles. The bridge device includes a plastic wall angle section to be secured onto the wall. The wall angle section includes a cross-sectional, approximately Z-shaped plastic angle section to be secured onto the wall and has an elastically linked wall-connecting leg. The wall-connecting leg is displaceably received in a pocket which is formed within the plastic floor angle section securable onto the floor. An angular bend is molded onto the inner leg of the floor pocket receiving the wall-connecting leg. The angular bend forms an additional cavity for receiving the edges of the abutting ceramic tiles. The angular bend is covered by a transition section strip having approximately triangularly-shaped cross-section, which section strip is preferably made of an elastic material.

8 Claims, 1 Drawing Sheet

DEVICE FOR FORMING A CONNECTING TRANSITION BETWEEN TWO SURFACES WITH RIGID COVERINGS ABUTTING ONE ANOTHER AT RIGHT ANGLES

BACKGROUND OF THE INVENTION

1. Field of the Invention

The present invention relates to a device for forming a connecting transition/expansion joint bridge between two surfaces with rigid coverings abutting one another at right angles, in particular between a wall and the floor, which are covered with ceramic tiles.

2. The Prior Art

Such a device made of suitable plastic angle sections is known from published German patent application DE-OS-35 03 396. With such a device, which substantially consists of two plastic angle sections, it is possible to compensate to a sufficient extent for the movements of the covered walls or floors occurring in every-day life due to structural changes, because of thermal expansions and contractions. They are used particularly if the covered floor areas have been installed on a substructure with insulating layers comprised of, for example, polystyrene foam which is sold under the trademark STYROPOR, as heat or sound insulation material. The polystyrene foam sold under the trademark STYROPOR can be used as boards or glass fiber mats which could collapse over the course of time, so that the floor sags to a relatively high degree. Floor sagging by several millimeters occurs under normal conditions of use during the life of a floor structure.

Shifting of the covered areas in their respective planes due to thermal expansion or contraction can occur to a considerable extent under normal conditions of use during the practical life of the structure. In addition, it can be noted that no direct connection of the abutting covered areas of hard material is possible for forming a sound insulation barrier.

When using such devices with two plastic angle sections, it has been found difficult to realistically form the expansion joint between the abutting ceramic tiles and the limiting leg of the angle section that is securable on the floor side. Because of acute angles of warpage which may occur in the floor and wall areas, and the fact that the abutting edges of the tiles generally must be cut, irregularities can result in the construction of the joint, which is usually filled with joint mortar. Furthermore, with the increasing use of so-called recycled materials in connection with known construction, the fact that the transition zone from the plastic angle section securable on the wall side to the angle section securable on the floor side is visible is a disadvantage. Angle sections made of such recycled plastic materials show highly apparent differences in coloring, which is aesthetically unacceptable, and therefore generally prevents the use of such recycled plastics.

SUMMARY OF THE INVENTION

It is an object of the present invention to provide an expansion joint bridge device that permits the use of plastic recycled material and enhances the appearance of the expansion joint bridge between the two areas having rigid coverings abutting one another at right angles.

The present invention achieves this object by providing a device for forming a connecting transition/ expansion joint bridge between a wall and a floor, each having a rigid covering and abutting one another at right angles, comprising a plastic wall angle section securable onto the wall and having an approximately Z-shaped cross-section and having a wall-connecting leg elastically linked with a wall-connecting bridge on a wall-fastening leg. A plastic floor angle section has a pocket, and has a floor-fastening leg. The wall-connecting leg is displaceably received in the pocket of the plastic floor angle section securable onto the floor. The pocket includes an inner pocket leg spaced apart from an outer pocket leg on the floor angle section arranged parallel to one another and perpendicular to a floor fastening leg of the floor angle section. The floor angle section has an angular bend molded on the top end side of the inner pocket leg of the pocket receiving the wall-connecting leg. The angular bend is directed inwardly substantially parallel to the fastening leg of the floor angle section securable onto the floor, and the angular bend forms a cavity for receiving edges of the abutting rigid coverings. A transition section strip covers the angular bend of said inner leg of the floor angle section and contacts the wall-connecting leg of the wall angle section securable onto the wall.

In the pocket for which provision is made in the floor angle section or floor bracket to be secured to the floor, the edges of the abutting rigid covering ceramic tiles are received, so that the resulting joint is not visible from the outside. The outer appearance of the expansion joint bridge, which has been covered, provides an attractive transition appearance from the floor to the wall. This transition section covers the part of the connecting leg of the wall angle section or wall bracket to be secured to the wall, which part is visible from the outside. Therefore, plastic recycled materials can be used for both angle sections. Only the strip of the transition section is manufactured from uniformly dyed material. The material can be molded by known thermal deformation techniques such as hot pressing or in a co-extrusion process even with angle sections that are manufactured as one piece, and are to be secured onto the floor. Thus, the angle section itself can be of recycled material as well. The use of a soft molded plastic enhances the operability of the expansion joint bridge.

In a further embodiment of the invention, the entire wall-connecting leg structure is manufactured from molded soft elastic material, which promotes the displaceability of the floor area in its plane. It is possible to combine a hard plastic section made from recycled material with the wall-connecting leg made from a soft plastic material of the same color using a co-extrusion process.

In another embodiment of the invention, a strip of soft plastic material is molded on top of the outer leg of the pocket receiving the wall-connecting leg, preferably by soft-adjusted thermal deformation of the end segment of the outer pocket leg. Sound wave reflections are prevented by this embodiment.

BRIEF DESCRIPTION OF THE DRAWINGS

Other objects and features of the present invention will become apparent from the following detailed description considered in connection with the accompanying drawings, which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
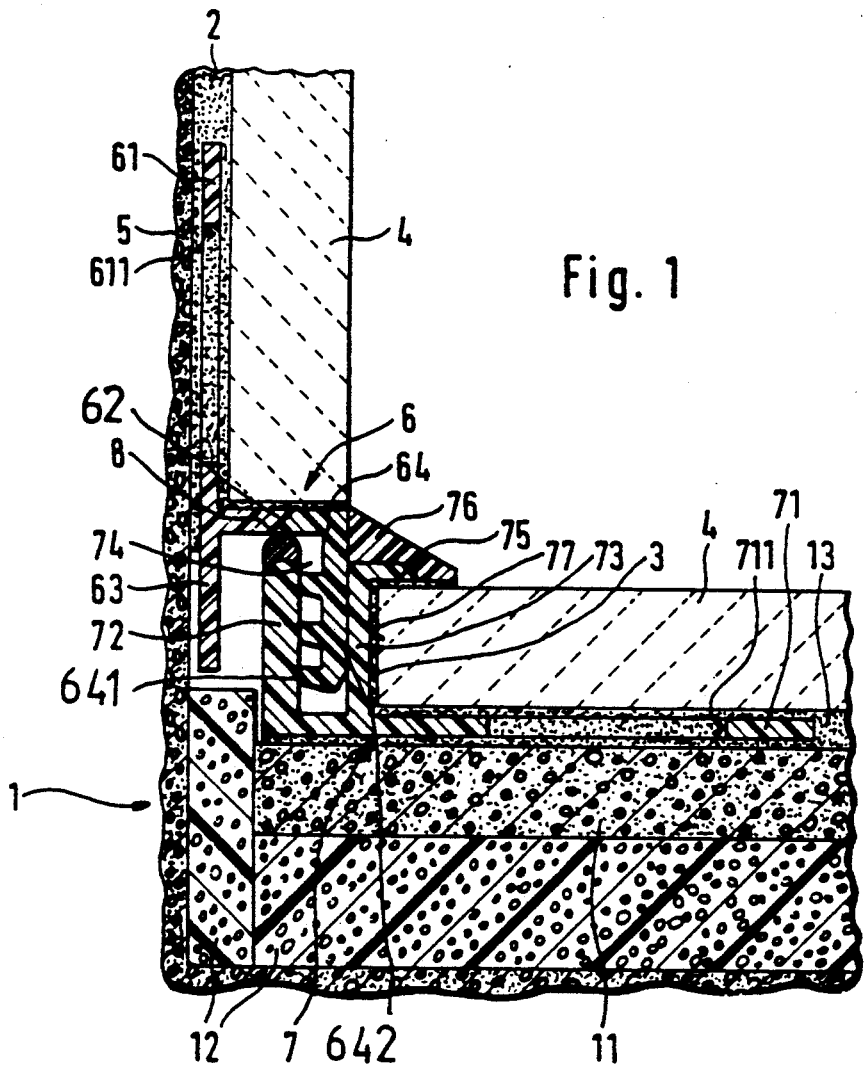
FIG. 1 shows a section through a floor-wall corner zone covered with ceramic tiles and with a connecting transition bridge/expansion joint device according to the invention.
Figure 2:
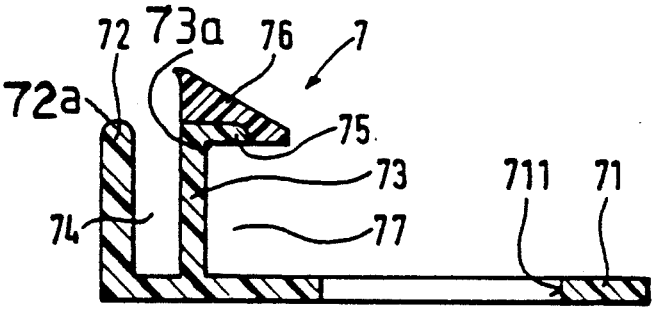
FIG. 2 shows a section through the angle section to be secured onto the floor of the corner zone.
Figure 3:
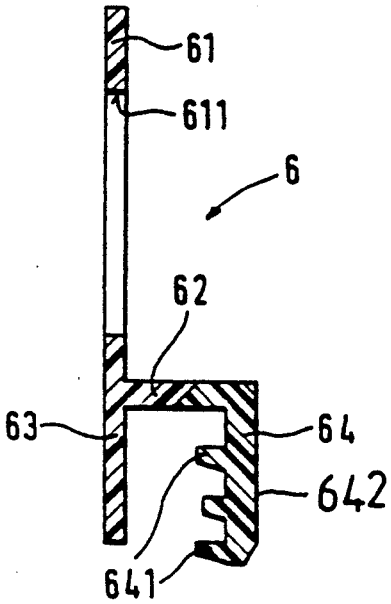
FIG. 3 shows a section through the angle section to be secured onto the wall of the corner zone.

Turning now in detail to the drawings, FIG. 1 shows the structure of a floor 1 with a supporting flooring substrate 11, which is embedded in a heat and sound insulating layer 12, for example in polystyrene foam sold under the trademark STYROPOR. With a spacing from the wall 5, a floor angle section or floor bracket 7 to be secured onto the floor is held in place by means of an adhesive layer 13. The adhesive penetrates through the perforation openings 711 in the fastening leg 71. On the floor angle section 7, an upwardly open floor pocket 74 is formed between the two legs, outer pocket leg 72 and inner pocket leg 73, which are arranged perpendicular to the fastening leg 71 with a parallel spacing between legs 72 and 73.

The internal space of floor pocket 74 is kept free of mortar and adhesive. On the top end 73*a* of the inner pocket leg 73, an angular bend 75 is formed by being molded on the outside and pointing in the direction of the ceramic tile 4. Bend 75, like the other pocket legs 72 and 73 of the section 7, are preferably made of a hard plastic material. The angular bend 75 is at the top end 73*a*, and is perpendicular to leg 73, and parallel to leg 71, and faces away from leg 72 so as not to obstruct the top opening of floor pocket 74. Beneath the angular bend 75, a cavity 77 is formed in which a hard covering ceramic tile 4 is inserted in such a way that the joint 3 formed between the leg 73 and the edge of the ceramic tile 4 is not visible from the outside. The angular bend 75 is covered by a molded-on transition strip 76 made of a shaped soft molded plastic material. Strip 76 projects upwardly with its approximately triangular cross-sectional shape. It is possible also to form the angular bend 75 and the strip of the transition section from the same material. Transition strip 76 is held in place by compressive forces that result when the heated strip 76 cools in contact with bend 75.

An associated wall angle section or wall bracket 6 is secured onto wall 5 by its fastening leg 61 immersed within the mortar or adhesive layer 2. The fastening leg 61 in turn has the perforation openings 611. In this regard, the two angle sections 6 and 7 are preferably arranged perpendicular relative to each other. In this manner, the wall-connecting leg 64 of the plastic wall angle section 6 has an approximately Z-shaped zigzag-shaped cross-section. This connecting wall leg 64 is molded onto a wall-connecting bridge 62, and fits within the pocket 74 on the floor angle section 7. Leg 64 is secured therein by friction fit even though wall leg 64 is displaceable as it is inserted into floor pocket 74. In this regard, the angle wall section 6 to be secured onto the wall is preferably made from a hard plastic material. The elastic connecting leg 64 is reverse E-shaped and molded on as one piece by suitable soft reshaping of the plastic material. The interlocking elements 641 project at a right angle to the flat surface part 642 of leg 64 and serve for sealing the pocket 74 by providing further frictional fit with outer leg 72, whereas inner leg 73 provides frictional fit with the flat surface part 642 of leg 64.

For providing a superior fitting, an arm 63 made of hard plastic material is molded onto the wall angle section to be secured onto the wall. Arm 63 is a continuous extension of the fastening leg 61, is perpendicular to bridge 62, and is parallel to surface 642.

In order to separate the parts of the angle sections 6 and 7 comprising hard plastic material so that these parts cannot come into direct contact with other structures within the expansion joint, which would create resonance chambers with unpleasant sounds, a strip 8 made of a compressible soft material is located on the top end 72*a* of outer leg 72 of the pocket 74. Strip 8 can also be formed by a suitable softening and adjusting of the outer top end 72*a* of the leg 72.

The floor bracket 7 and the wall bracket 6 can each be made of a metal, such as aluminum, brass or steel, or can be made of a hard plastic.

The hard plastic material can be made of a thermoplastic such as a polyolefin, such as polyethylene, polyvinyl chloride, or a thermosetting resin such as a phenol formaldehyde resin.

While only one embodiment of the present invention has been shown and described, it is to be understood that many changes and modifications may be made thereunto without departing from the spirit and scope of the invention as defined in the appended claims.

What is claimed is:

1. Device for forming a connecting transition expansion joint bridge between a wall and a floor, each having a rigid covering and abutting one another at right angles, comprising:

a wall angle section securable onto said wall and having an approximately Z-shaped cross-section and having a wall-connecting leg elastically linked with a wall-connecting bridge on a wall-fastening leg;

a floor angle section having a pocket; and having a floor-fastening leg;

said wall-connecting leg displaceably received in said pocket of said floor angle section securable onto said floor;

said pocket comprising an inner pocket leg spaced apart from an outer pocket leg on said floor angle section arranged parallel to one another and perpendicular to a floor fastening leg of said floor angle section;

wherein said floor angle section has an angular bend molded on the top end side of the inner pocket leg of the pocket receiving the wall-connecting leg, said angular bend being directed inwardly substantially parallel to the floor-fastening leg of the floor angle section securable onto the floor, and said angular bend forming a cavity for receiving edges of the abutting rigid coverings; and a transition section strip covering said angular bend of said inner pocket leg of said floor angle section and contacting the wall-connecting leg of the wall angle section securable onto the wall.

2. The device according to claim 1, wherein the transition section strip in combination with the angular bend covered by said strip has an approximately triangular cross-sectional shape.

3. The device according to claim 1, wherein the transition section strip comprises soft-shape adjusted plastic material molded onto the angular bend.

4. The device according to claim 1, wherein the wall-connecting leg of the wall angle section comprises soft-shape adjusted plastic formed onto the wall-connecting bridge made of hard plastic material and attached to a wall-fastening leg of the wall angle section securable onto the wall.

5. The device according to claim 1, wherein a strip of soft plastic material formed by molding is located on top of the outer pocket leg of the pocket receiving the wall-connecting leg.

6. The device according to claim 5, wherein said strip comprises a soft-shape adjustment of the plastic material at the top end of the outer pocket leg.

7. The device according to claim 1, wherein the floor angle section is plastic.

8. The device according to claim 1, wherein the wall angle section is plastic.

* * * * *